US007631847B2

(12) United States Patent
Harrison et al.

(10) Patent No.: US 7,631,847 B2
(45) Date of Patent: Dec. 15, 2009

(54) POWER TOOL BRACKET

(75) Inventors: Ryan Harrison, Anderson, SC (US); Robert E. McCracken, Anderson, SC (US); James A. Keith, Jr., Pickens, SC (US)

(73) Assignee: Techtronic Power Tools Technology Limited, Tortola (VG)

( * ) Notice: Subject to any disclaimer, the term of this patent is extended or adjusted under 35 U.S.C. 154(b) by 37 days.

(21) Appl. No.: 11/679,461

(22) Filed: Feb. 27, 2007

(65) Prior Publication Data

US 2008/0203259 A1 Aug. 28, 2008

(51) Int. Cl.
*A47G 1/10* (2006.01)

(52) U.S. Cl. ..... 248/316.1; 248/229.1

(58) Field of Classification Search ..... 248/316.1, 248/316.5, 316.4, 229.1, 229.12, 229.13, 248/229.2, 229.22, 229.33, 228.3, 228.4, 248/227.3, 227.4, 223.41, 231.5, 287.1, 292.14, 248/298.1, 485, 487

See application file for complete search history.

(56) References Cited

U.S. PATENT DOCUMENTS

| | | | | |
|---|---|---|---|---|
| 2,583,786 | A | | 1/1952 | Marzucco |
| 2,586,724 | A | | 2/1952 | Sannebeck |
| 3,769,920 | A | | 11/1973 | Weiss |
| 3,872,755 | A | | 3/1975 | Marsh et al. |
| 3,931,751 | A | | 1/1976 | Simonson |
| 4,068,551 | A | | 1/1978 | Kreitz |
| 4,191,111 | A | | 3/1980 | Emmert |
| 4,213,592 | A | * | 7/1980 | Lingenfelser ..... 248/313 |
| 4,248,115 | A | | 2/1981 | Brodbeck et al. |
| 4,341,247 | A | | 7/1982 | Price |
| 4,452,117 | A | | 6/1984 | Brickner et al. |
| 4,557,200 | A | | 12/1985 | Geschwender |
| 4,605,099 | A | | 8/1986 | Crum et al. |
| 4,726,405 | A | | 2/1988 | Bassett |
| 4,804,064 | A | | 2/1989 | Coultrup et al. |
| 4,817,693 | A | | 4/1989 | Schuler |
| 4,874,025 | A | | 10/1989 | Cleveland |
| 4,903,796 | A | | 2/1990 | Magyar et al. |
| 4,969,496 | A | | 11/1990 | Romans |
| 5,087,013 | A | | 2/1992 | Gress et al. |
| 5,105,862 | A | | 4/1992 | Skinner et al. |
| 5,161,590 | A | | 11/1992 | Otto |
| 5,165,148 | A | * | 11/1992 | Fleischer et al. ..... 24/494 |
| 5,193,598 | A | | 3/1993 | Estrem |
| 5,247,976 | A | | 9/1993 | Matthews |
| 5,255,724 | A | | 10/1993 | Butke |
| 5,320,150 | A | | 6/1994 | Everts et al. |
| 5,379,815 | A | | 1/1995 | Brazell et al. |
| 5,379,816 | A | | 1/1995 | Charlton |
| 5,479,840 | A | | 1/1996 | Hilliard et al. |

(Continued)

FOREIGN PATENT DOCUMENTS

| | | | | |
|---|---|---|---|---|
| JP | 404019497 | A | * | 1/1992 ..... 248/346.06 |

*Primary Examiner*—Ramon O Ramirez
(74) *Attorney, Agent, or Firm*—Michael Best & Friedrich LLP

(57) ABSTRACT

A bracket includes a body with a first clamp and a second clamp. The first clamp is pivotably mounted and operatively engaged with a first lever that is pivotable between a release position and a locking position. A second lever is operatively engaged with the first lever to prevent the first lever from pivoting from a locking position to a release position.

28 Claims, 8 Drawing Sheets

U.S. PATENT DOCUMENTS 5,497,816 A 3/1996 Darland
5,518,053 A 5/1996 Robison
5,526,856 A 6/1996 Pedri
5,560,582 A 10/1996 Beelen
5,577,429 A 11/1996 Noble
5,592,981 A 1/1997 Derecktor
RE35,627 E 10/1997 Estrem
5,697,411 A 12/1997 Vandaele
5,778,953 A 7/1998 Braddock
5,836,365 A 11/1998 Derecktor
5,863,021 A * 1/1999 Nichols ..... 248/229.23
5,863,052 A 1/1999 Roman
5,865,228 A 2/1999 Patterson
5,868,054 A 2/1999 Chubb et al.
5,868,185 A 2/1999 Poling et al.
5,875,828 A 3/1999 Quiram et al.
5,921,301 A 7/1999 Quiram et al.
5,957,472 A 9/1999 Borgatti
5,988,243 A 11/1999 Ayala et al.
6,029,721 A 2/2000 O'Banion
6,044,775 A 4/2000 Lashlee et al.
6,045,103 A * 4/2000 Costa et al. ..... 248/278.1
6,058,990 A 5/2000 Kent
6,112,785 A 9/2000 Yu
6,152,462 A 11/2000 Barrett
6,199,608 B1 3/2001 Ayala et al.
6,240,987 B1 6/2001 Birkeland
6,293,176 B1 9/2001 Talesky
6,360,797 B1 3/2002 Brazell et al.
6,386,119 B1 5/2002 Lin
6,401,579 B2 6/2002 Lei
6,415,831 B2 7/2002 Ayala et al.
6,439,526 B1 * 8/2002 London ..... 248/316.5
6,471,236 B1 10/2002 Eskridge
6,578,856 B2 6/2003 Kahle
6,595,251 B2 7/2003 Ayala et al.
6,607,015 B1 8/2003 Chen
6,672,348 B2 1/2004 Ransom et al.
6,705,192 B2 3/2004 Logan
6,708,593 B1 3/2004 Weselyk
6,745,804 B2 6/2004 Welsh et al.
6,748,987 B2 6/2004 Ayala et al.
6,854,495 B2 2/2005 Logan
6,883,793 B2 4/2005 Fortin et al.
6,932,073 B2 8/2005 Zhang
6,948,539 B1 9/2005 Barker et al.
7,036,540 B2 5/2006 Welsh et al.
7,047,856 B2 5/2006 Nurenberg et al.
7,048,021 B2 5/2006 Ayala et al.
7,055,563 B2 6/2006 Logan
7,066,224 B2 6/2006 Gilmour
7,077,179 B1 7/2006 Camiano et al.
7,201,192 B2 4/2007 Makropoulos
2003/0024604 A1 2/2003 Derecktor
2003/0167980 A1 9/2003 Suzuki
2004/0250903 A1 12/2004 Welsh
2005/0006002 A1 1/2005 Barclay deTolly
2005/0072493 A1 4/2005 Velasco
2005/0199768 A1 9/2005 Tam et al.
2005/0218577 A1 10/2005 Kent
2006/0180244 A1 8/2006 Ayala et al.
2006/0272744 A1 12/2006 Liu et al.

* cited by examiner

POWER TOOL BRACKET

BACKGROUND

It is common in the construction industry and for amateur craftsman for a user to bring tools to a worksite for the sake of convenience and efficiency. Many power tools, such as miter saws and the like are extremely heavy, which makes it prohibitive to carry these types of tools extended distances to a job site. Accordingly, it is common to mount power tools on a cart, foldable stand, or other type of transport apparatus to assist in moving a power tool to the job site. Accordingly, many stands include mechanisms to releasably connect a power tool to the stand, to allow the power tool to be retained on the stand both when the stand is being transported to or from a job site and when the stand is unfolded to provide a horizontal surface to support the power tool for use at the job site. Many conventional connecting mechanisms or structures for stands are relatively difficult to connect and disconnect to the stand and the power tool and require a large amount of time and specific tools to attach and remove the connecting mechanism from the stand.

SUMMARY

A first representative embodiment of the present invention provides a bracket. The bracket includes a body having first end and a second end and a first clamp pivotally mounted on the body. A first lever is connected to the first clamp and pivotable between a release position and a locking position. A second lever is operatively engaged with the first lever to prevent the first lever from pivoting from a locking position to a release position.

A second representative embodiment of the present invention provides a bracket for receiving a tool. The bracket includes a body extending along a longitudinal axis and including at least one clamping member. A top plate is attached to the body and includes with first and second apertures. A first fastener is disposed within the body with a portion extending through the first aperture, wherein the first fastener is adjustable along the body in a first direction parallel to the longitudinal axis of the body and in a second direction perpendicular to the longitudinal axis of the body.

Advantages of the present disclosure will become more apparent to those skilled in the art from the following description of the preferred embodiments of the invention that have been shown and described by way of illustration. As will be realized, the disclosure is capable of other and different embodiments, and its details are capable of modification in various respects. Accordingly, the drawings and description are to be regarded as illustrative in nature and not as restrictive.

DESCRIPTION

Figure 1:
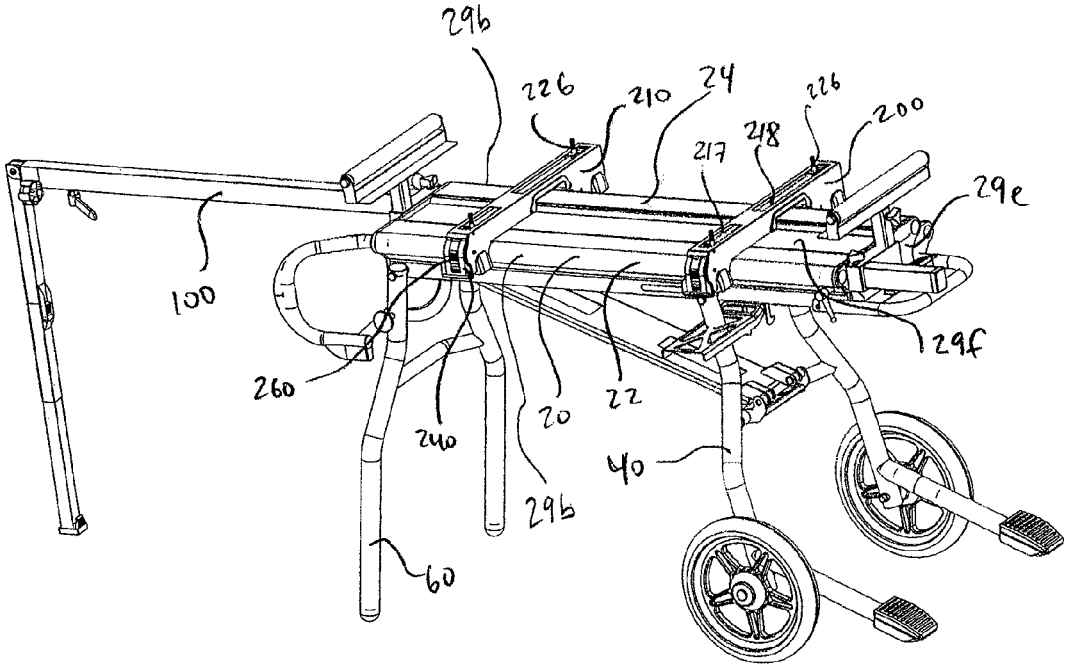
FIG. 1 is a perspective view of a foldable stand with a plurality of brackets installed thereupon.
Figure 2:
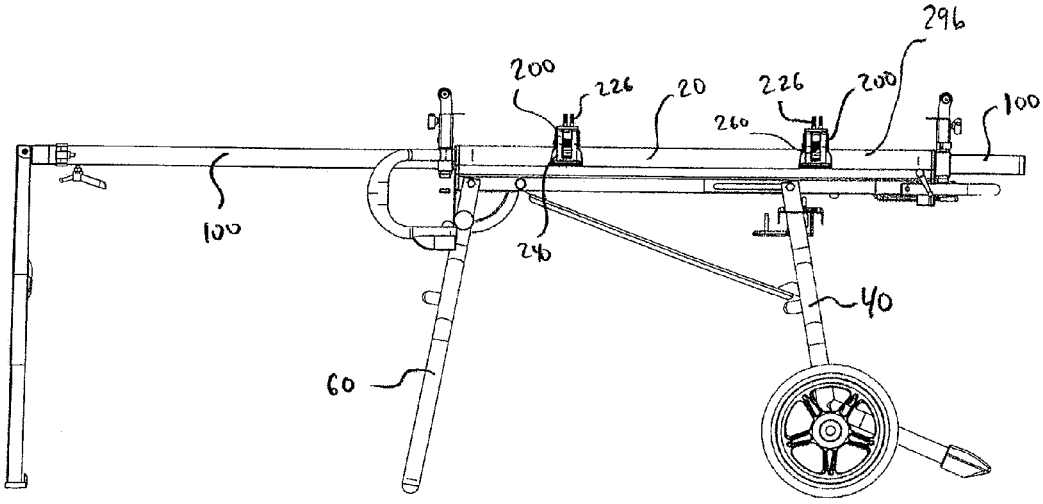
FIG. 2 is a side view of the foldable stand of FIG. 1.

Referring now to the embodiments shown in FIGS. 1-8, a removable bracket 200 for use with a foldable stand 10 is provided. The bracket 200 includes a retaining or locking mechanism that includes first and second clamps 300, 320 that are movable or adjustable to allow the bracket 200 to be installed and removed from a platform 20 of a foldable stand 10. In other embodiments, the bracket 200 may be installed and removed from any other suitable structure with sufficient geometry to be lockingly received between the first and second clamps 300, 320, whether fixed or transportable.

The first clamp 300 is adjustable with a locking mechanism that includes a locking handle 240 and a ratchet handle 260 that prevents the locking handle 240 from spuriously or unintentionally opening. A second clamp 320 is provided opposite the first clamp 300 and adjustably mounted to the bracket 200. The bracket 200 includes at least one upstanding fastener 226 that is received within an aperture in the base of a power tool (not shown) to fix the power tool to the bracket 200, and therefore the stand 10.

The stand 10 that receives the bracket 200 may include components found in many different stands 10, such as a saw receiving platform 20, a plurality of pivotable legs 40, 60, and an extension arm 100 that is telescopically received within the platform 20. The foldable legs 40, 60 may fold and be retained in either the use or transport positions using a plurality of structures and mechanisms. The stand 10 and its method of operation is discussed in detail in U.S. patent application Ser. No. 11/679,530 filed Feb. 27, 2007, the same date that the subject patent application was filed, titled "Foldable Stand for Supporting a Power Tool," the entire content of which is incorporated herein by reference.

The platform 20 of foldable stand 10 may include two cylindrical side members 22 with arcuate outer surfaces 29*b* that extend along the length of the platform 20. The side members 22 provide opposing surfaces that receive the first and second clamps 300, 320 of the bracket 200 to lock the bracket 200 onto the stand 10. The platform 20 may also include a raised or extended member 24 that extends along the length of the platform 20. The bracket 200 may be fixedly mounted to the platform 20 at any location along the length of the platform 20, which allows the bracket 200 to be useful at retaining a plurality of different types of power tools from different manufacturers. As discussed in detail below, the position of the upstanding fastener 226 from the bracket 200 is adjustable in the direction parallel to the longitudinal axis 200*a* of the bracket 200 and in the direction perpendicular to the longitudinal axis 200*a* of the bracket 200 to allow the bracket 200 to retain a plurality of different types of power tools that are formed with different sized and shaped bases. In some embodiments, two or more brackets 200 may be used with the stand 10 to retain a power tool.

As best shown in FIGS. 3-7, the bracket 200 extends between a first end 201 and a second end 202 and is substantially enclosed by a body 210. The body includes two side plates 212 and an end plate 212*a*. A track 213 is provided near the top surface of the body 210 and translatably supports two slidable plates 220, discussed below. A top plate 216 is mounted to the body above the track 213, and includes first and second apertures 217, 218 that expose a portion the respective slidable plate 220. The top plate 216 is formed with the same number of apertures as plates 220 and fasteners 226 on the bracket 200. The body 210 may define a recessed portion 214 that provides clearance for an extended member 24 of the platform 20.

The bracket 200 includes two or more plates 220 that are slidably mounted along the track 213. Each plate 220 includes a slot 222 oriented perpendicular to the track 213. A fastener 226 is upstandingly inserted through the slot 222 in the plate 220 such that an enlarged head 227*a* of the fastener 226 is positioned below the plate 220 and the body of the fastener extends upward through the slot 222 in the plate and through one of the first or second apertures 216, 217 in the top plate 213. The fastener may be a carriage bolt that includes a non-circular cross section 227*b* in the vicinity of the head 227*a* that engages the slot 222 to prevent the fastener 226 from rotating within the slot 222. In other embodiments, a plurality of different types of suitable fasteners may be used. The fastener 226 is slidable along at least a portion of the length of the slot 222 to adjust the position of the fastener 226 in a direction perpendicular to the bracket 200.

The fastener 226 may include a threaded section 227*c* that is engageable with a corresponding nut (not shown) in the opposite side of the power tool base to fix the power tool to the bracket 200. The fastener 226 is adjustable in a first direction parallel to the longitudinal axis 200*a* of the bracket 200 by sliding the plate 220 along the track 213 and independently in a second direction, along the length of the slot 222, perpendicular to the longitudinal axis 200*a* of the bracket 200. Accordingly, the fasteners 226 may be positioned in a plurality of positions within the bracket 200, and only constrained by the size of the first or second apertures 217, 218 and the length of the slot 222 in the plate 220.

The first clamp 300 is pivotably mounted to the body 210 of the bracket 200 and provides a first locking surface for engagement with the platform 20. Specifically, the first clamp 300 includes an arcuate surface 304 that is similar to the outer profile of the cylinder or side member 22 of the platform 20. The bracket 200 is retained on the platform 20 by pivoting the first clamp 300 about a pivot connection 302 with the body 210 to selectively engage one of the side members 22 of the platform, which grabs and/or surrounds a portion of the side member 22 in combination with the second clamp 320 that grabs or surrounds a portion of the opposite side member 22.

The first clamp 300 is pivoted about the body 210 with rotation of a locking lever 240. The locking lever 240 is pivotably mounted to the body 210 by a pinned connection 246 through a push rod 248 that extends outward from the locking lever 240. The pin 250 that extends through the push rod 248 includes an eccentric portion 252. A follower 254 extends radially from the eccentric portion 252 of the pin and translates approximately linearly when the eccentric portion 252 rotates with the rotation of the locking lever 240. The follower 254 contacts the rear surface (opposite the arcuate surface 304) of the first clamp 300, to cause or allow the first clamp to rotate about the body 210 through the pivot connection 302. Specifically, when the locking lever 240 is rotated in the direction X as shown on FIG. 6, the first clamp 300 similarly rotates in the direction X due to the rotation of the eccentric portion 252 of the pin 250 and the simultaneous near linear motion of the follower 254. Rotation of the first clamp 300 in the direction X causes the first clamp 300 to engage one of the side members 22 of the platform 20, if the bracket 200 is positioned on the platform 20.

Figure 6:
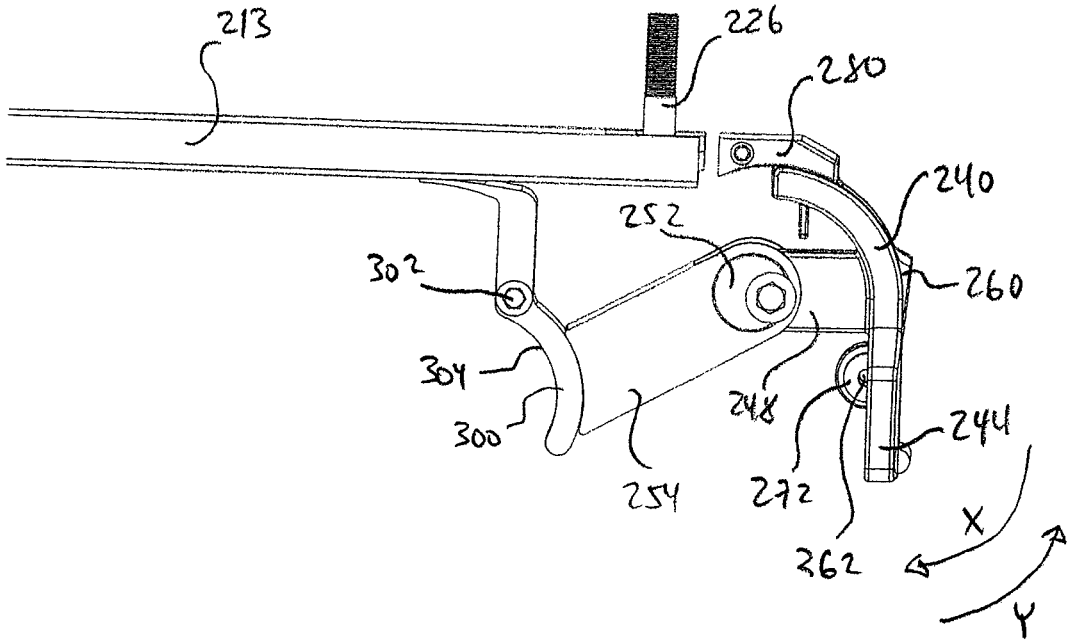
FIG. 6 is a side view of the view of FIG. 5.

When the locking lever 240 is rotated in the opposite direction Y as shown on FIG. 6, the eccentric portion 252 similarly rotates in the direction Y and causes the follower 254 to move substantially linearly away from the first clamp 300. The movement of the follower 254 allows the first clamp 300 to rotate away from the side member 22 on the platform 20, and to release the compressive contact between the bracket 200 and the platform 20, which allows the bracket 200 to be removed from the platform 20.

A second ratchet lever 260 is pivotably connected to the locking lever 240 and prevents rotation of the locking lever 240 in the Y direction without simultaneous operation of the ratchet lever 260. The ratchet lever 260 is mounted within a recessed portion 242 of the locking lever 240 and is pivotably connected to the locking lever 240 with a pinned connection 262. The ratchet lever 260 includes a operable portion 264 that may include several ridges or other features defined therein to provide a high friction connection with a user's thumb or finger to allow the user to rotate the ratchet lever 260. The ratchet lever 260 includes a tongue 266 that may extend from the operable portion 264. The tongue 266 may be formed of an arcuate shape or another suitable shape to allow for releasable locking engagement between one of a plurality of teeth 268 that extend from the tongue 266 of the ratchet lever 260 and a corresponding tooth 282 that extends from a stop member 280. The plurality of teeth 268 on the ratchet lever 260 are formed as ratchet teeth, with each tooth 268 including an inclined face 269*a* and a perpendicular face 269*b*.

Figure 7:
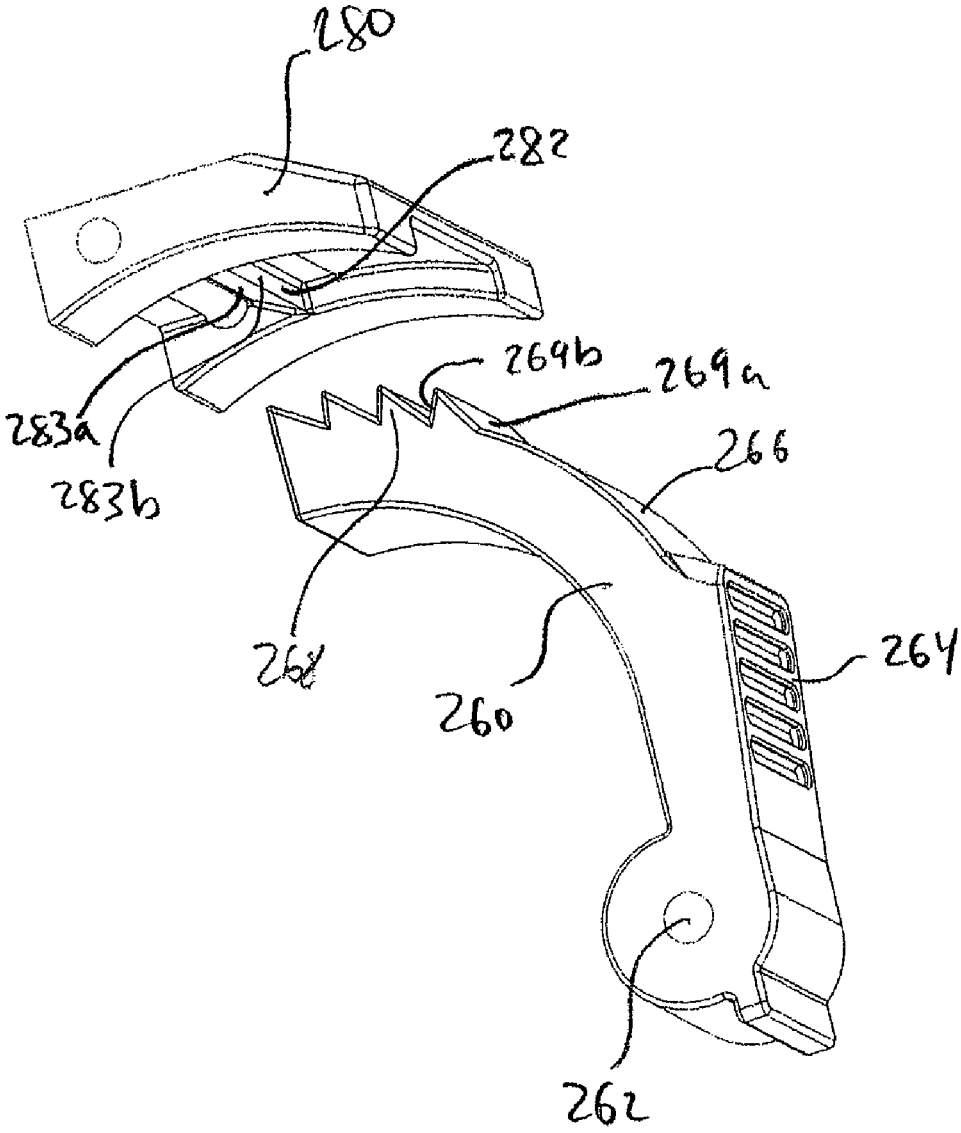
FIG. 7 is an exploded view of the ratchet lever and the stop member of the mechanism of FIG. 5.
Figure 8:
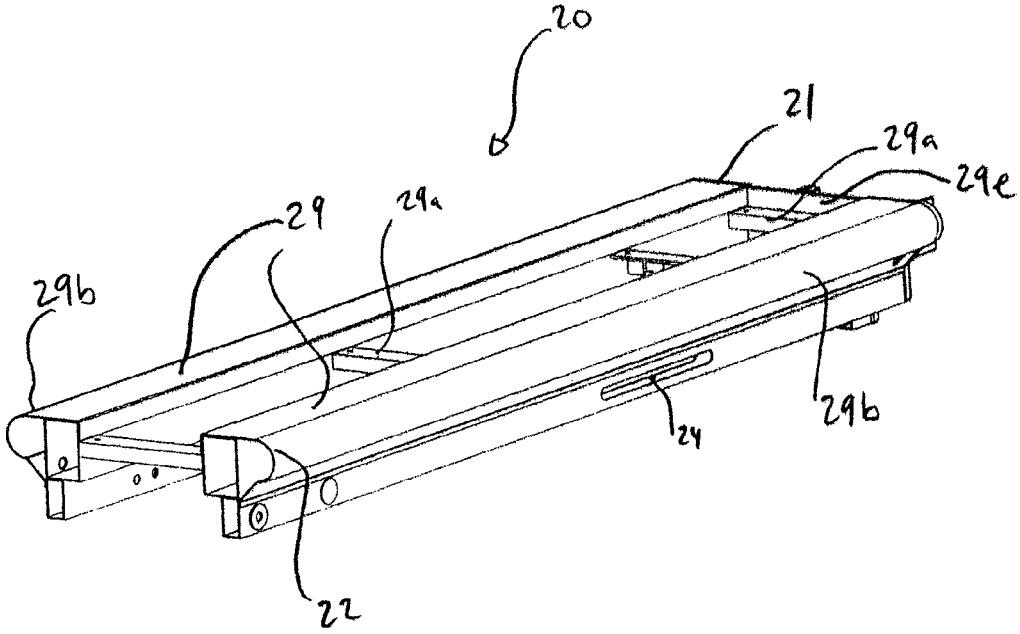
FIG. 8 is a perspective view of the platform of the foldable stand of FIG. 1.

The stop member 280 is rigidly mounted to the body 210 of the bracket 200 and includes a tooth 282 that extends toward the ratchet lever 260. As best shown in FIG. 7, the tooth 282 is a ratchet tooth that corresponds to the plurality of teeth 268 in the ratchet lever 260 and includes an inclined face 283*a* and a perpendicular face 283*b*. The ratchet lever 260 is biased toward engagement with the stop member 280 with a biasing member 270, such as a spring, that is enclosed within a casing 272 on the locking lever 240. Specifically, the spring 270 biases the ratcheting lever 260 toward engagement with the stop member 280 (i.e. engagement between one of the plurality of teeth 268 of the ratchet lever 260 and the tooth 282 of the stop member 280). The teeth 268 of the ratchet lever 260 disengage the tooth 282 of the stop member 280 when the operable portion 264 is pressed by the user against the biasing force of the spring 270.

As best understood with reference to FIGS. 6 and 7, when the locking lever 240 is rotated in the direction X to compress the first clamp 300 against the platform 20, the ratchet lever 260 rotates in the same direction X due to the pinned connection 262 between the two levers. As the ratchet lever 260 rotates, the inclined faces 269*a*, 283*a* of each of plurality of teeth 268 and the tooth 282, respectively, make sliding contact with each other, and allows the ratchet lever 260 to move past the stop member 280 in a ratcheting fashion. When the first clamp 300 is sufficiently rotated in the direction X (FIG. 6) to engage with the platform 20, the ratchet lever 260 is prevented from rotating in the opposite direction Y (FIG. 6) due to the engagement between opposing perpendicular faces 269*b*, 283*b* of the teeth 268, 282 that extend from the ratchet lever 260 and the stop member 280, respectively. Accordingly, the bracket 200 is effectively "locked" onto the platform 20 and will not become unlocked due to spurious contact with the locking lever 240, normal vibrations during operation of the tool attached to the bracket 200, or transport of the stand 10, etc.

When it is desired to release the bracket 200 from the stand 10, the user may compress the operable portion 264 of the ratchet lever 260 toward the locking lever 240, which slightly rotates the ratchet lever 260 against the biasing force of the spring 270. With sufficient compression of the ratchet lever 260, the perpendicular faces 269*b*, 283*b* of the teeth 269, 282 of the ratchet lever 260 and stop member 280, respectively, disengage from each other and allows the ratchet lever 260 and locking lever 240 to rotate in the direction Y (FIG. 6). As the locking lever 240 rotates in the direction Y, the push rod 248 similarly rotates, which causes the pin 250 and the eccentric portion 252 to similarly rotate. This rotation causes the follower 254 to move substantially linearly away from the first clamp 300. The motion away from the first clamp 300 allows the first clamp 300 to similarly rotate away from the platform 20 to relieve the compression between the first and second clamps 300, 320 and the platform 20. With sufficient rotation of the locking lever 240, the first clamp 300 is allowed to sufficiently pivot or rotate to allow the bracket 200 to be removed from the platform 20.

Figure 3:
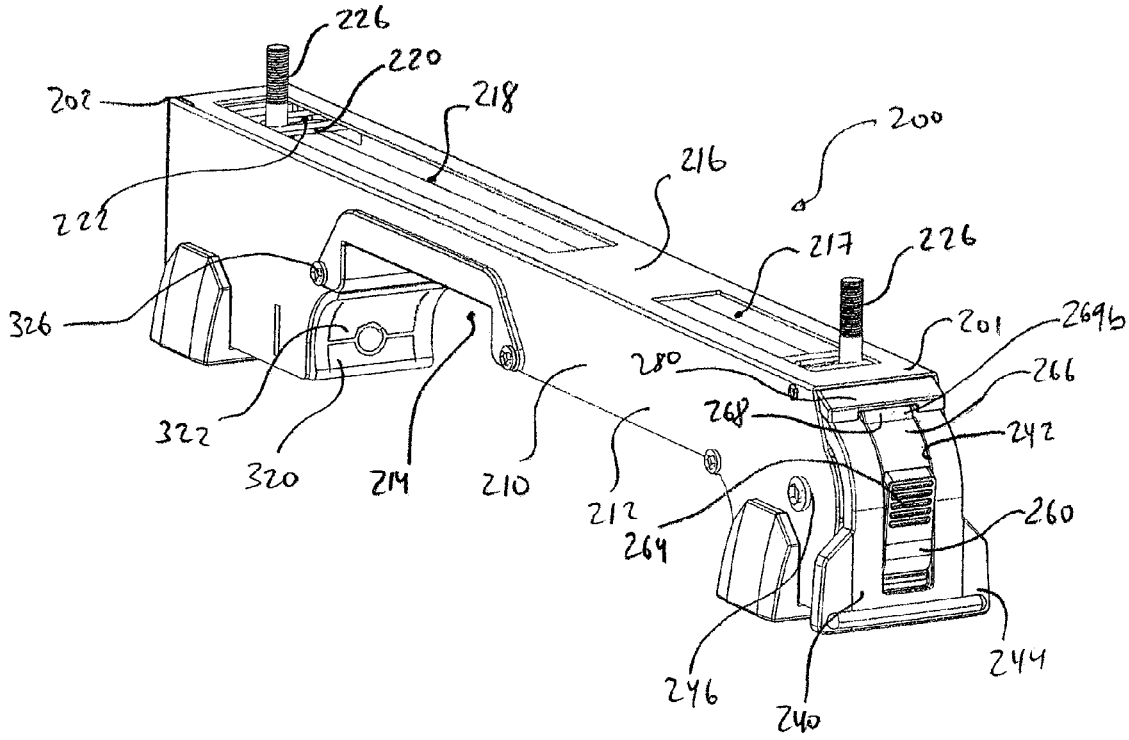
FIG. 3 is a perspective view of the bracket of FIG. 1.
Figure 4:
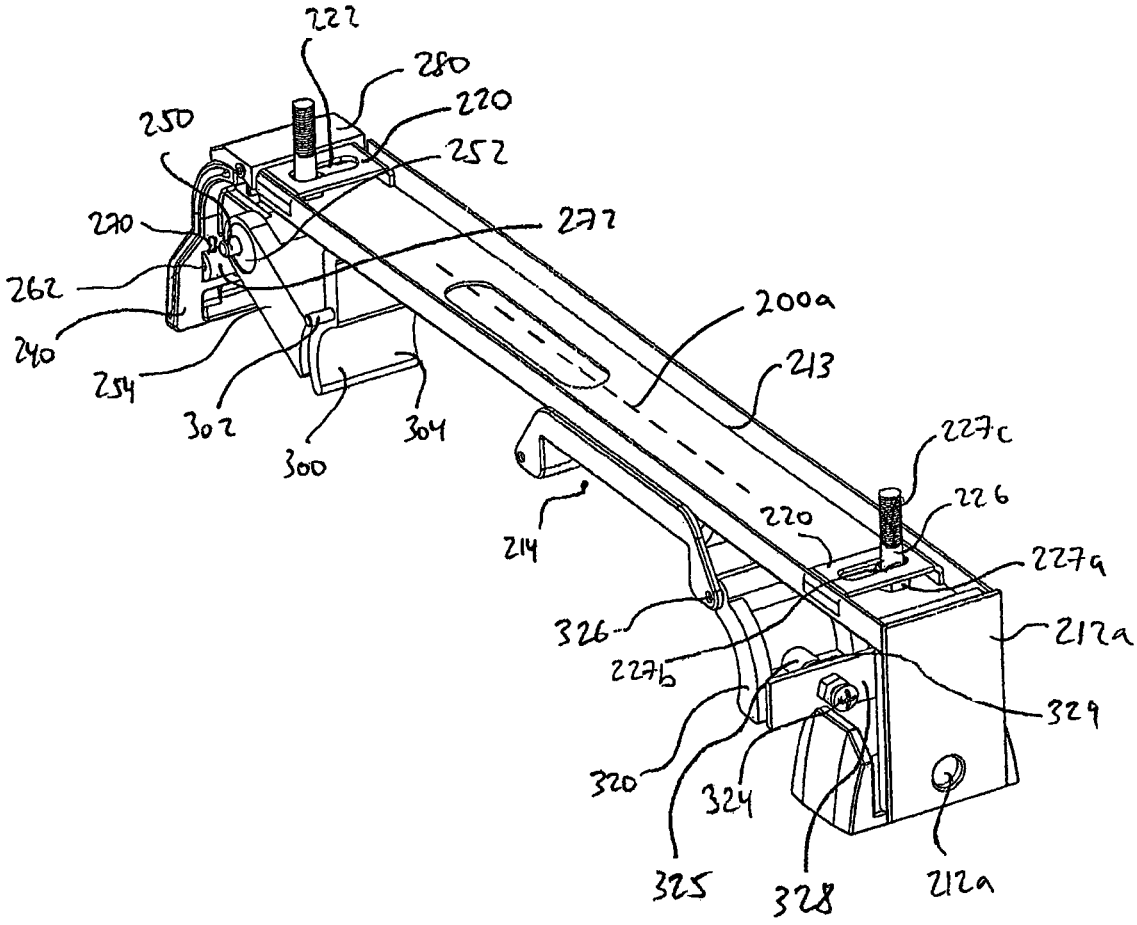
FIG. 4 is another perspective view of the bracket of FIG. 3 with the body and the top plate removed.
Figure 5:
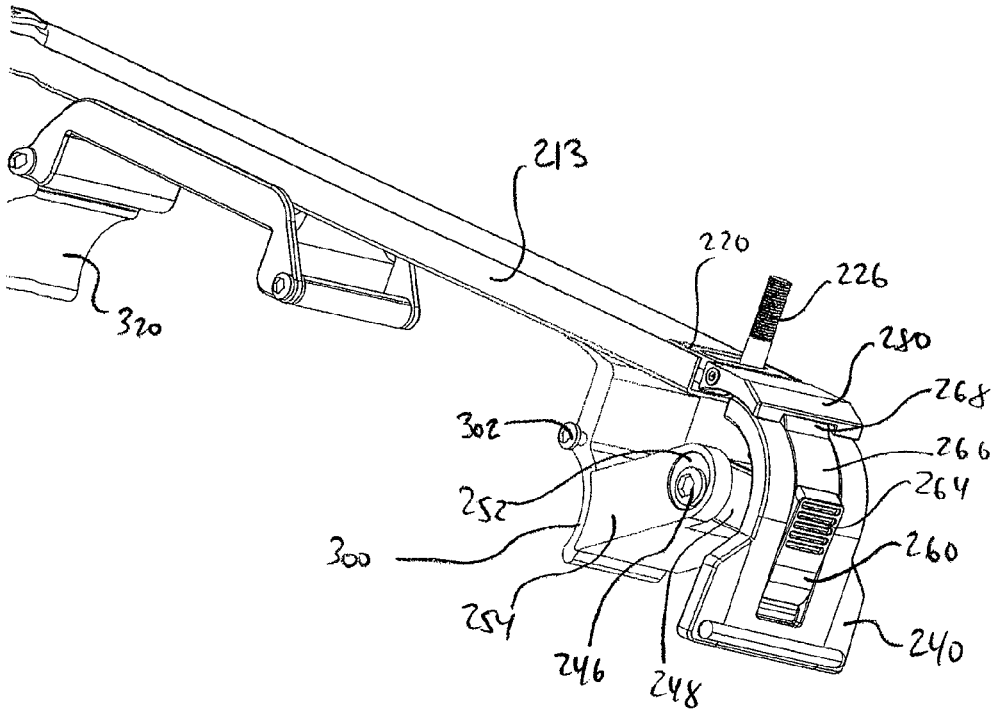
FIG. 5 is another perspective view of FIG. 4 showing the mechanism to operate and lock the first clamp.

As best shown in FIGS. 3 and 4, the second clamp 320 is pivotably mounted to the body 210 of the bracket 200, in the vicinity of the second end 202 of the bracket 200. The second clamp 320 is connected to the body 210 with a pivotable connection 326. The position of the second clamp 320 is adjustable with operation of a screw 324 or similar fastener that is inserted into a tapped aperture 325 that extends from the back surface (i.e. opposite from the arcuate surface 322) of the second clamp 320. The body 210 of the bracket 200 includes a plate 328 that is provided at a suitable distance behind the second clamp 320 and a spring 329 or suitable biasing member is provided between the plate 328 and the second clamp 320 around the circumference of the screw 324.

The end plate 212*a* of the body 210 includes an aperture that is inline with the screw 324 to allow the position of the screw 324, and therefore the position of the second clamp 320 to be adjusted. When the bracket 200 is installed on the platform 20, the second clamp 320 provides a compressive force on the corresponding side member 22 of the platform 20, due to the biasing force of the spring 329 as compressed by the screw 328.

It is apparent that apparatus incorporating modifications and variations to the bracket 200 of the present invention described above will be obvious to one skilled in the art. Inasmuch as the foregoing disclosure is intended to describe the present invention the above description should not be construed to limit the present invention but should be construed to include any obvious variations and should be limited only by the spirit and scope of the following claims. It is therefore intended that the foregoing detailed description be regarded as illustrative rather than limiting, and that it should be understood that it is the following claims, including all equivalents, that are intended to define the spirit and scope of this invention.

What is claimed:

1. A bracket comprising:

a body having a first end and a second end;

a first clamp pivotably mounted to the body;

a first lever connected to the first clamp and pivotable between a release position and a locking position;

a second lever operatively engaged with the first lever to prevent the first lever from pivoting from the locking position to the release position; and a second clamp spaced from the first clamp, wherein the first and second clamps compressively engage a structure disposed between the clamps when the first lever is in the locking position to retain the body to the structure.

2. The bracket of claim 1, wherein the compressive engagement upon the structure disposed between the first and second clamps is released when the first lever is in the release position.

3. The bracket of claim 1, wherein the first clamp pivots when the first lever is moved between the release and locking positions.

4. The bracket of claim 1, further comprising an eccentric member pivotably engaged with the first lever, and comprising a follower that engages the first clamp to cause the first clamp to pivot as the first lever pivots.

5. The bracket of claim 1, wherein the second lever is rotatably mounted to the first lever.

6. The bracket of claim 1, further comprising at least one fastener movably mounted within the body with a portion of the fastener extending out of the body.

7. The bracket of claim 6, wherein the position of the fastener is adjustable in a direction parallel to a longitudinal axis of the body and in a direction perpendicular to the longitudinal axis of the body.

8. The bracket of claim 1, further comprising a stop member fixed to the body and being selectively engageable with the second lever.

9. A bracket comprising:

a body having a first end and a second end;

a first clamp pivotably mounted to the body;

a first lever connected to the first clamp and pivotable between a release position and a locking position;

a second lever rotatably mounted to the first lever to prevent the first lever from pivoting from the locking position to the release position; and a stop member fixed to the body and being selectively engageable with the second lever.

10. The bracket of claim 9, wherein the stop member comprises a tooth that is engageable with a tooth on the second lever.

11. The bracket of claim 10, wherein the tooth on the second lever comprises a plurality of parallel teeth.

12. The bracket of claim 11, wherein the plurality of teeth each include a perpendicular face and an inclined face.

13. The bracket of claim 12, wherein the plurality of teeth slide past the tooth on the stop member as the first lever is pivoted in a first direction.

14. The bracket of claim 13, wherein engagement between the tooth on the stop member and perpendicular face of one of the plurality of teeth substantially prevents the first lever from pivoting in a second direction opposite to the first direction.

15. The bracket of claim 14, wherein the second lever comprises a button, wherein engagement is removed between the tooth on the stop member and the plurality of teeth on the second lever when the button is depressed.

16. The bracket of claim 15, wherein the second lever rotates about the first lever when the button is depressed.

17. The bracket of claim 14, wherein the second lever is biased to urge engagement between the tooth on the stop member and one of the plurality of teeth on the second lever.

18. The bracket of claim 9, further comprising a second clamp spaced from the first clamp, wherein the first and second clamps are operable to secure the body to a structure disposed between the first and second clamps when the first lever is in the locking position.

19. The bracket of claim 18, wherein the first and second clamps are operable to release the body from the structure when the first lever is in the release position.

20. The bracket of claim 9, wherein the first clamp pivots when the first lever is moved between the release position and the locking position.

21. The bracket of claim 9, further comprising:

an eccentric member pivotably engaged with the first lever; and a follower that engages the first clamp to cause the first clamp to pivot as the first lever pivots.

22. The bracket of claim 9, further comprising at least one fastener movably mounted within the body with a portion of the fastener extending out of the body.

23. The bracket of claim 22, wherein the position of the fastener is adjustable in a direction parallel to a longitudinal axis of the body and in a direction perpendicular to the longitudinal axis of the body.

24. A bracket for receiving a tool comprising:

a body extending along a longitudinal axis, comprising at least one clamping member and a top plate with first and second apertures; and a first fastener disposed within the body with a portion extending through the first aperture, wherein the first fastener is adjustable along the body in a first direction parallel to the longitudinal axis of the body and in a second direction perpendicular to the longitudinal axis of the body; and a plate slidably mounted within the body comprising a slot perpendicular to the longitudinal axis of the body through which the first fastener extends therethrough.

25. A bracket for receiving a tool comprising:

a body extending along a longitudinal axis, comprising at least one clamping member and a top plate with first and second apertures; and a first fastener disposed within the body with a portion extending through the first aperture, wherein the first fastener is adjustable along the body in a first direction parallel to the longitudinal axis of the body and in a second direction perpendicular to the longitudinal axis of the body; and a second fastener disposed within the body with a portion of the fastener extending through the second aperture of the top plate, wherein the second fastener is adjustable in a first direction parallel to the longitudinal axis of the body and in a second direction perpendicular to the longitudinal axis of the body.

26. A bracket for receiving a tool comprising:

a body extending along a longitudinal axis, comprising at least one clamping member and a top plate with first and second apertures;

a first fastener disposed within the body with a portion extending through the first aperture; and a plate slidably mounted within the body comprising a slot perpendicular to the longitudinal axis of the body through which the fastener extends therethrough, wherein the first fastener is adjustable along the body in a first direction parallel to the longitudinal axis of the body and independently in a second direction perpendicular to the longitudinal axis of the body.

27. The bracket of claim 26, further comprising a second fastener disposed within the body with a portion of the second fastener extending through the second aperture of the top plate, wherein the second fastener is adjustable in a first direction parallel to the longitudinal axis of the body and in a second direction perpendicular to the longitudinal axis of the body.

28. A bracket for receiving a tool comprising:

a body extending along a longitudinal axis, comprising at least one clamping member and a top plate with first and second apertures;

a first fastener disposed within the body with a portion extending through the first aperture, wherein the first fastener is adjustable along the body in a first direction parallel to the longitudinal axis of the body and independently in a second direction perpendicular to the longitudinal axis of the body; and a second fastener disposed within the body with a portion of the second fastener extending through the second aperture, wherein the second fastener is adjustable in a first direction parallel to the longitudinal axis of the body and in a second direction perpendicular to the longitudinal axis of the body.

* * * * *